US006354067B2

(12) United States Patent
Foil, Jr.

(10) Patent No.: US 6,354,067 B2
(45) **Date of Patent: *Mar. 12, 2002**

(54) PROCESS FOR PRODUCING DYED SPUN COTTON YARNS HAVING IMPROVED UNIFORMITY, PHYSICAL PROPERTIES, AND LUSTER AND YARNS THUS PRODUCED

(75) Inventor: Martin Boger Foil, Jr., Concord, NC (US)

(73) Assignee: Tuscarora Yarns, Inc., Mt. Pleasant, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/435,106

(22) Filed: Nov. 5, 1999

Related U.S. Application Data

(62) Division of application No. 09/080,053, filed on May 15, 1998.

(51) Int. Cl.[7] ..... D01H 1/00

(52) U.S. Cl. ..... 57/1 R; 57/244; 57/252; 57/255; 57/256; 57/257; 57/258

(58) Field of Search ..... 57/1 R, 244, 252, 57/255, 256, 257, 258

(56) References Cited

U.S. PATENT DOCUMENTS

| | | | |
|---|---|---|---|
| 1,736,592 A | | 11/1929 | Gwaltney |
| 2,373,191 A | | 4/1945 | Landolt et al. |
| 2,542,314 A | | 2/1951 | de Lacotte |
| 2,671,250 A | | 3/1954 | Fidell |
| 2,851,849 A | | 9/1958 | Merrill |
| 3,604,197 A | | 9/1971 | Saidaiji et al. |
| 3,864,902 A | | 2/1975 | Wehling et al. |
| 3,987,615 A | | 10/1976 | Hill |
| 3,988,108 A | | 10/1976 | Segoshi et al. |
| 4,335,185 A | | 6/1982 | Adelman et al. |
| 4,369,213 A | | 1/1983 | Adelman et al. |
| 4,539,806 A | | 9/1985 | Stahlecker |
| 4,699,627 A | | 10/1987 | Bailey |
| 4,753,066 A | | 6/1988 | Briner et al. |
| 4,773,209 A | | 9/1988 | Briner et al. |
| 5,025,533 A | | 6/1991 | Faas et al. |
| 5,155,989 A | * | 10/1992 | Frey et al. ..... 57/327 |
| 5,331,801 A | | 7/1994 | Heifetz |

OTHER PUBLICATIONS

Kathryn L. Hatch, "Textile Science" 1993, West Publishing Company, 1st Ed., p. 434–435.*

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A process for producing dyed spun cotton yarns having a reduced number of irregularities and increased luster is described. The process involves dyeing at least a portion of the cotton fibers which are to form the yarn, then combing the dyed fibers subsequent to the dyeing process. The dyed and combed fibers are then optionally blended with fibers having a visually distinct appearance, and spun into a yarn using conventional spinning methods. The resulting yarns having a dramatically reduced number of thick and thin places and improved yarn properties including improved luster and hand. Furthermore, when the thus-dyed fibers are blended with differently-colored fibers prior to the combing operation, the resultant yarns match the visual colors of like-colored yarns produced by conventional processes, while the color is more intimately blended and the yarns have a markedly increased uniformity, luster and tenacity. As a result, fabrics produced from the yarns have a superior appearance with respect to color blend and luster, and the number of neps and irregularities are dramatically reduced with respect to those of conventionally-produced fabrics.

1 Claim, 9 Drawing Sheets

| | | | USTER EVENNESS TEST | | |
|---|---|---|---|---|---|
| Sample | Fiber Type | Average Yarn Size | Average Coefficient of Variation | Highest Coefficient of Variation | Lowest Coefficient of Variation |
| A | Carded only | 18.099 | 24.10% | 25.69% | 23.50% |
| B | Natural only combed | 17.302 | 21.69% | 22.84% | 20.98% |
| C | Combed natural Dyed Blend combed | 17.611 | 14.45% | 14.72% | 14.03% |

FIG.2A.

| Average Thin Places | Average Thick Places | Average Neps | Average Break Factor |
|---|---|---|---|
| 488 | 1549 | 421 | 1755 |
| 234 | 1162 | 186 | 1738 |
| 0 | 73 | 33 | 2377 |

FIG.2B.

STATIMAT M SINGLE END TEST

| Sample | Elongation (%) | | | Force (grams) | | |
|---|---|---|---|---|---|---|
| | Average | High | Low | Average | High | |
| A | 5.5 | 5.7 | 5.4 | 391 | 408 | |
| B | 5.9 | 6.2 | 5.6 | 427 | 452 | |
| C | 6.4 | 6.6 | 6.1 | 568 | 624 | |

FIG.3A.

STATIMAT M SINGLE END TEST

| Force (grams) | Tenacity (grams/denier) | | |
|---|---|---|---|
| Low | Average | High | Low |
| 377 | 1.32 | 1.38 | 1.28 |
| 430 | 1.45 | 1.53 | 1.29 |
| 513 | 1.92 | 2.11 | 1.74 |

FIG.3B.

| | | | USTER EVENNESS TEST | | |
|---|---|---|---|---|---|
| Sample | Fiber Type | Average Yarn Size | Average Coefficient of Variation | Highest Coefficient of Variation | Lowest Coefficient of Variation |
| D | 50% scratch combed natural 50% scratch combed, dyed Blend carded | 18.038 | 22.59% | 23.37% | 21.54% |
| E | 50% nat'l Process 2 combed 50% scratch combed, dyed | 18.098 | 17.55% | 18.15% | 17.03% |
| F | 50% Process 2 combed natural 50% dyed, process 2 combed Blend Process 2 combed | 17.904 | 13.88% | 15.35% | 12.95% |

FIG.4A.

| Average Thin Places | Average Thick Places | Average Neps | Average Break Factor |
|---|---|---|---|
| 355 | 1291 | 143 | 1736 |
| 29 | 563 | 178 | 2102 |
| 1 | 22 | 7 | 2846 |

FIG.4B.

| STATIMAT M SINGLE END TEST | | | | | |
|---|---|---|---|---|---|
| Sample | Elongation (%) | | | Force (grams) | |
| | Average | High | Low | Average | High |
| D | 4.3 | 4.7 | 4.0 | 372 | 445 |
| E | 6.6 | 6.8 | 6.5 | 456 | 487 |
| F | 6.1 | 6.3 | 6.0 | 596 | 646 |

FIG.5A.

| STATIMAT M SINGLE END TEST | | | |
|---|---|---|---|
| Force (grams) | Tenacity (grams/denier) | | |
| Low | Average | High | Low |
| 341 | 1.26 | 1.51 | 1.16 |
| 441 | 1.54 | 1.65 | 1.49 |
| 573 | 2.02 | 2.19 | 1.94 |

FIG.5B.

| | | | USTER EVENNESS TEST | |
|---|---|---|---|---|
| Sample | Fiber Type | Average Yarn Size | Average Coefficient of Variation | Highest Coefficient of Variation |
| G | 9% fibers scratch combed then dyed 91% carded natural blend carded | 18.479 | 17.44% | 20.33% |
| H | 9% fibers dyed, then Process 2 combed 91% natural carded fibers | 19.019 | 16.52% | 17.14% |
| I | 9% fibers dyed, then Process 2 combed blended with 91% Process 2 combed natural fibers, then blend Process 2 combed | 17.560 | 14.08% | 14.63% |
| J | 9% fibers dyed, then Process 2 combed blended with 91% natural carded fibers, blend then Process 2 combed | 17.721 | 13.92% | 14.64% |

FIG.6A.

USTER EVENNESS TEST

| Lowest Coefficient of Variation | Average Thin Places | Average Thick Places | Average Neps | Average Break Factor |
|---|---|---|---|---|
| 16.22% | 94 | 529 | 96 | 2204 |
| 15.65% | 28 | 308 | 55 | 2011 |
| 13.20% | 0 | 29 | 12 | 2726 |
| 13.70% | 0 | 102 | 63 | 2736 |

FIG.6B.

| STATIMAT M SINGLE END TEST | | | | | |
|---|---|---|---|---|---|
| Sample | Elongation (%) | | | Force (grams) | |
| | Average | High | Low | Average | High |
| G | 5.2 | 5.5 | 4.7 | 487 | 522 |
| H | 4.6 | 5.1 | 4.1 | 438 | 469 |
| I | 5.6 | 5.9 | 5.3 | 601 | 637 |
| J | 6.2 | 6.6 | 5.7 | 583 | 625 |

FIG.7A.

| STATIMAT M SINGLE END TEST | | | |
|---|---|---|---|
| Force (grams) | Tenacity (grams/denier) | | |
| Low | Average | High | Low |
| 450 | 1.65 | 1.77 | 1.53 |
| 412 | 1.56 | 1.68 | 1.47 |
| 517 | 2.04 | 2.16 | 1.75 |
| 539 | 1.97 | 2.12 | 1.83 |

FIG.7B.

PROCESS FOR PRODUCING DYED SPUN COTTON YARNS HAVING IMPROVED UNIFORMITY, PHYSICAL PROPERTIES, AND LUSTER AND YARNS THUS PRODUCED

CROSS-REFERENCE TO RELATED APPLICATION

The present application is a divisional of U.S. patent application Ser. No. 09/080,053 filed May 15, 1998, which is currently pending and has been allowed.

BACKGROUND OF THE INVENTION

1. Field of the Invention

The invention generally relates to a process for spinning cotton yarns. More specifically, the invention relates to a process for producing dyed spun cotton yarns having minimal irregularities and increased luster and tenacity, and the yarns thus produced.

2. Description of the Prior Art

For thousands of years, cotton yarns have been used in the production of apparel and other goods. In addition to being cost efficient, cotton has good absorbency, is comfortable to wear, launders well, and tends to be relatively durable.

Cotton fibers are the hairs which grow on the cotton seeds. Cotton is harvested when mature, and taken to a cotton gin where the fibers, also known as cotton lint, are stripped from the seeds. If performed well, the ginning process minimizes the pick-up of unwanted plant material, while retaining some of the natural oils on the fibers. The fibers are then combined and compressed into large bales (generally on the order of about 500 pounds each) and transported for processing.

Because cotton is a natural fiber, it can come in many varying forms. In addition to their being various types of cotton plants themselves, the cotton lint produced can be affected by the composition of the soil, amount of rainfall and sunlight which the plant receives, etc. As a result, individual fibers can vary in shape, diameter, and in fiber length, etc., with the longer length fibers being generally preferred for high quality apparel applications.

Because cotton fibers are hair-like, they also have a tendency to become entangled with each other during processing. Such thickness variations, tangles and trash result in irregularities in the yarns which the fibers are used to produce; it therefore can be desirable to reduce the number of such variations and tangles during the processing steps prior to yarn spinning.

As noted above, the cotton fibers are generally provided to a yarn spinning facility in bale form. These bales are then broken up and trash is removed from the fibers. This process is commonly referred to as "opening", and the fibers emerge from the opening process in a loose, fluffy mass. However, this mass may still include significant amounts of trash and short and tangled fibers, which need to be removed before the fibers can be spun into a high quality yarn.

Cotton fibers are therefore typically processed through an operation known as carding, to remove the undesirable trash, neps (small knots of entangled fibers that will not usually straighten to a parallel position during carding), and noils (fibers which are undesirably short). In the carding machine, the clumps of fiber are contacted with pin-covered rollers which grab and remove a number of the tangled and short fibers and trash and align the fibers. The emerging carded stock is generally condensed to form card sliver.

Where a high degree of yarn uniformity is desired, the card stock can be further processed through a combing machine. In one common form of combing operation, a number of ends of card sliver are fed in the form of a lap to the combing machine. In the combing operation, fine metal wires are used to clean out a number of remaining short fibers and other impurities. The combed stock is then generally condensed into what is known as comber sliver. Because the comber is designed to remove small impurities, it thus generally results in a loss of a relatively large percentage of the input fiber material; for example, as much as 17 percent of the input material can be lost as a result of a typical combing operation. In order to minimize this loss of material and to prevent damage to the combing machine, heretofore it has been considered to be critical that the fibers which are input to the combing machine are in an aligned and trash-free condition.

Where the production of colored yarns is desired, the cotton fibers are conventionally carded and then dyed. For the production of colored yarns having fewer irregularities, manufacturers typically comb the natural fibers as well. Because dyeing tends to entangle the fibers with each other and the fibers emerge from the dyeing process in a matted form, it has heretofore been the industry standard to comb the fibers prior to the dyeing process, as it has been considered to be necessary that the fiber stock fed to the dyeing machine was well aligned to prevent the significant further entanglement of the fibers during the dyeing process. However, the dyeing process tends to impart tangles and mat the fibers together, such that subsequent separation of the fibers for spinning results in the imparting of additional neps and tangles. To avoid this problem, yarn manufacturers often spin combed natural (i.e., undyed) cotton fibers with dyed card stock, then label the resulting product as a combed dyed yarn.

Despite traditional carding and combing operations, the yarns produced by prior art methods still contain a number of irregularities, such as thick and thin areas and neps or slubs. Depending on the fabric being produced by the yarns, the appearance of the neps may or may not present a significant problem. For example, in some types of fabrics, the neps are seen to add to the character of the fabric while in others, a nep appearing within a garment can result in its failing quality inspection and being classified as a factory second or low quality fabric. The appearance of neps tends to become a more significant issue in yarns containing a blend of more than one color of fibers. For example, in grey yarns made from a mixture of black and white fibers, the appearance of a black nep can significantly diminish the visual appearance of a fabric made from the yarns.

Another difficulty encountered in the production of spun cotton yarns which mix more than one color of fiber is that it is difficult to get a consistent blend of the colors. As a result, knit fabrics produced from conventional multi-colored yarns often have what is known as a banding or window pane effect, in which bands of one of the fiber colors stand out in the knit fabric.

With the foregoing in mind, it is therefore an object of the present invention to provide a process for providing dyed spun cotton yarns having improved uniformity and color consistency. It is also an object of the present invention to provide a method for making spun yarns having improved luster, and which can be produced at competitive rates of production with prior art methods.

SUMMARY OF THE INVENTION

These and other objects are provided by the process of the instant invention, in which at least a portion of the fibers forming a yarn are combed subsequent to the fiber dyeing process. As noted above, conventional wisdom dictates that fiber dyeing is performed subsequent to any fiber alignment steps such as carding and combing. This is because dyeing processes are generally wet processes, which have a tendency to drastically increase fiber entanglement, with the increase in entanglement correlating with the initial degree of entanglement. For purposes of illustration, the entanglement is similar to the case of hair washing, where hair which is initially entangled has a tendency to become dramatically more entangled when washed, as opposed to hair which is brushed prior to washing. Thus, one would expect that it would be physically impractical to comb dyed fibers subsequent to the dyeing operation, without inflicting tremendous damage to the long fibers and removing a large percentage of the input fiber. In addition, because of the matted, hard condition in which the fibers emerge from the dyeing process, one would expect that conventional combing equipment could not be used to comb dyed fibers, without damage to and build up of fibers on the comber.

Surprisingly, however, the instant inventor has discovered that by combing the fibers subsequent to the dyeing operation, spun yarns having greatly improved uniformity can be readily and efficiently produced. Furthermore, it has been found that by blending multiple colors of fibers prior to the combing operation, yarns having a much greater intimacy of color blend can be achieved, while not affecting the overall color of the yarn. In addition, the thus-produced yarns have greatly enhanced luster and softness, as well as tenacity.

BRIEF DESCRIPTION OF THE DRAWING

FIGS. 2A and 2B, when joined at their respective broken ends, show a table of Uster Evenness Test results corresponding to Example 1;

DETAILED DESCRIPTION OF THE INVENTION

Figure 1:
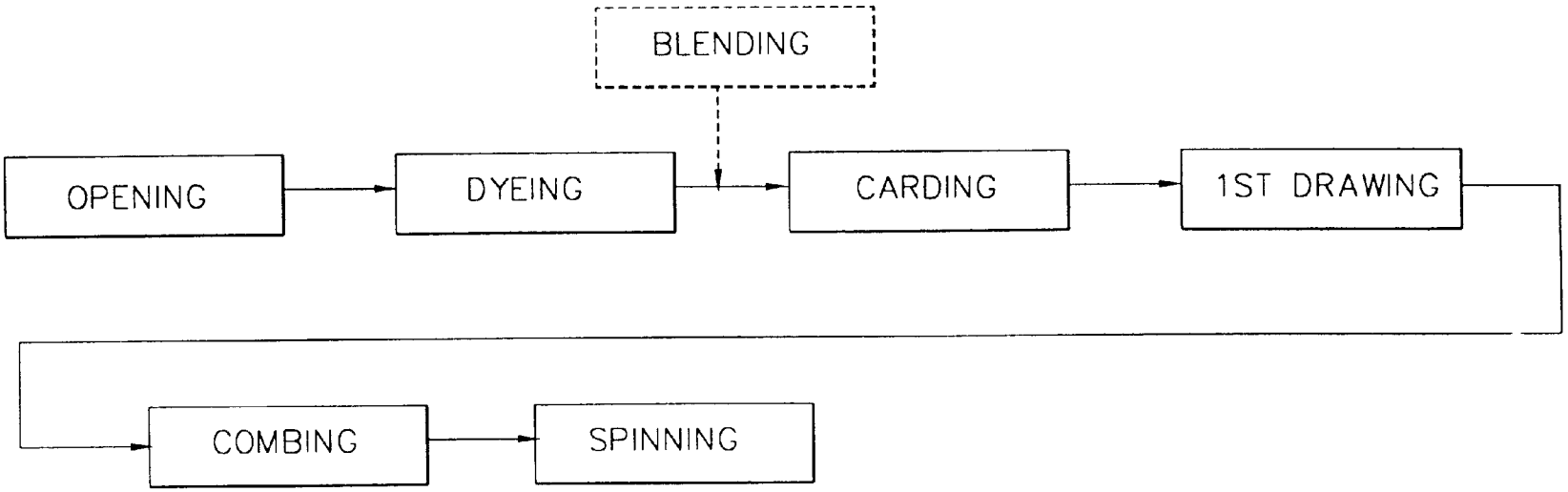
FIG. 1 is a flowchart illustrating steps taken during the process of the instant invention.

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

With reference to FIG. 1, bales of cotton fibers are opened in a conventional manner. The fibers can optionally go through an initial carding process to provide some alignment at this stage of the process. In the process according to the instant invention, cotton fibers are dyed to achieve a predetermined color, using conventional fiber dyeing methods such as batch dyeing. (For purposes of this application, the term "cotton fibers" is meant to describe batches of fibers in which a major portion of the fibers are the seed hairs from the seeds of cotton plants. The batches may also include other types of fibers conventionally used in combination with cotton fibers, within the scope of the instant invention.)

The dyed yarns are then carded according to conventional carding methods, and may go through an initial drawing stage as well, although not required. The fibers are then combed using commercially available combing machinery, such as the Saco-Lowell CA comber. In a preferred form of the invention, a combing machine set up with approximately 1420 teeth per square inch (as opposed to the industry standard of about 1002 teeth per square inch) has been found to perform well in combing the dyed fibers. Such a high tooth gauge is particularly surprising, since one would expect that the tangled state of the fibers which are input to the comber would necessitate the use of a less aggressive combing arrangement. In addition, in a preferred form of the process of the invention, the air suction on the comber is increased from conventional levels to optimize the condition of the fiber output, and top combs which are in pristine condition are desirably used. While one would expect such conditions to be too aggressive even for natural fibers, the inventor has surprisingly discovered that the combed fibers are in excellent condition and that the tangled fiber input does not damage the comber, as one might expect. In a preferred form of the invention, the combing of the dyed fibers is performed to remove about 21–22% noils (as compared with about 17% noil removal from a "world class" combing of natural fibers).

In one form of the invention, fibers of two or more colors (one of which may be the color of the natural cotton fibers in their undyed form and at least one of which is dyed) are blended together, then all of the fibers are combed. In this form of the invention, it has surprisingly been found that the color of yarn which would be expected from conventional yarn processing methods of like-colored fibers is achieved, while the individually-colored fibers are more intimately blended together than with the conventional processing methods, so as to result in a more consistent color throughout the yarn.

In another form of the invention used to produce mixed-color yarns (e.g., heather yarns), the manufacturer determines which of the colors to be blended in the yarn will be the dominant fiber color. For example, grey heather yarns generally include about 9%black fibers and the rest natural-colored fibers. In such yarns, black is the dominant fiber color and in fabrics produced from the grey heather yarns, the black neps therefore have a tendency to show up more prominently than the naturally-colored neps. Therefore, in this embodiment of the invention, the manufacturer combs the dyed fibers which it has been determined will present the most dominant visual appearance (i.e., in the example, the black fibers), such that fewer irregularities exist in that fiber color. As a result, blended yarns spun from the dominantly-colored dyed combed fibers and the other colored fibers have a slightly lower overall nep count as compared with prior art yarns formed from like-colored fibers. (As will be understood, the reduction in overall nep count will depend somewhat on the percentage of the fibers forming the yarn which have been combed subsequent to dyeing. However, by strategically selecting which of the fiber inputs are to be combed, and by the inventor's development of a process for combing fibers subsequent to the dyeing process, marked improvements in yarn quality can be achieved through the use of only a small percentage of the dyed-then-combed fibers relative to the overall yarn composition.) Therefore, when the thus-produced yarns are formed into a piece of fabric, the overall appearance is that of a dramatic reduction in yarn neps. Thus, with only a minimal processing adjustment, a surprisingly remarkable increase in fabric quality can be realized. In addition, the thus-produced yarns have a dramatically reduced coefficient of variation, a reduced number of thick and thin places, increased breaking factor, and increased tenacity. Furthermore, the thus-produced yarns have a readily visible increase in luster, which greatly enhances the appearance of the yarn. In fact, in many of the yarns, and particularly those in which a dyed fiber quantity is combed prior to blending with a second quantity of fibers, and the blended fibers are then combed together, the resulting yarns are substantially free of visual irregularities, and fabrics produced from the yarns are substantially free of neps and visual irregularities. Thus, the instant invention enables the achievement of dramatic functional as well as aesthetic improvements.

In an alternative form of the invention, fibers are dyed then combed, then blended with fibers of another color. The blended fibers are then combed together, and spun into a yarn. The thus-produced yarns have enhanced luster over that of their conventionally-spun counterparts, and while the color is substantially the same as that which is achieved by conventional comb-then-dye methods of spinning blended yarns (as described above), the colors are significantly more intimately blended. The result is a yarn having a much lusher appearance than that of conventional yarns. In addition, the yarns have been found to be much softer, particularly when spun using ring spinning methods. It is to be noted, however, that fibers processed according to the instant invention can be formed into yarns using any conventional method, including but not limited to ring spinning, open end spinning, and air jet spinning methods. In fact, the fiber preparation process enables the production of finer-size open end spun yarns than have heretofore been achievable at commercially acceptable levels of production, since the improved consistency of the dyed fiber input results in fewer ends down during the spinning process.

In a particularly preferred method of the invention designed to achieve virtually nep-less heather yarns, the dyed fibers are combed, blended with natural fibers, and the blended fibers are combed together. As a result, the dyed fibers have thus undergone two combing operations. In this way, extremely high quality, soft yarns are produced which have more intimate fiber blending.

Because the dyeing process often has a tendency to strip some of the natural oils from the fibers, it has also been found to be desirable in some cases to add one or more conventional types of lubricant to the fibers prior to combing them, particularly where the ginning process has removed more than an optimal level of the fibers' natural oils. The amount and types of such lubricants can be readily selected depending on the particular batch of cotton fibers being processed without undue experimentation by someone having ordinary skill in the art.

EXAMPLES

A variety of yarns were prepared according to various embodiments of the instant invention, and the results are outlined below for purposes of comparison with the physical characteristics of conventionally-produced yarns. For purposes of description below, the term "scratch combed" is used to describe the combing of fibers which was performed at a machine set-up designed to remove approximately 2–4% of the fiber noils. As noted above, scratch combing is a common level of aggressiveness at which fibers are combed. Also for purposes of the examples, the term "Process 2 Combing" is intended to describe combing using a more aggressive machine set-up, to remove about 17% or greater of fiber noils.

In all of the examples, the highest quality 1⅛" staple length cotton fibers were used. Each of the samples was then measured to determine the average yarn size, and four 400 yard lengths of each yarn sample were analyzed using a Uster Evenness Tester to determine the coefficient of variation of each, number of thick and thin places, and the number of neps (i.e., piece of fiber which breaks and balls up, forming a pill on the outer surface of the yarn.) It is noted that the terms "thick" and "thin" places are recognized terms of art detected by the Uster Evenness Tester, as will be readily appreciated by those having ordinary skill in the art. The averages of each of these criteria were then calculated.

Elongation, force to break and yarn tenacity were then measured on twenty-five single ends of each yarn using a Statimat M Single End Tester in its conventional manner, as will be readily understood by those having ordinary skill in the art. The gauge length was set at 254 mm, the load cell at 10 N, the preload was 0.50 cN/tex, and the test speed was 5000 mm/min. Again, the average of each of these measurables was calculated, as was the break factor for each of the yarns.

Example 1

Samples A, B and C of forest green yarns including 80% dyed fibers and 20% natural fibers were produced as follows. A twist test was conducted for each of the yarns to determine the average turns per inch (tpi) and average twist multiple (tm), as noted below:

A. 18/1 Ne 100% cotton yarns were produced from 80% dyed fibers and 20% natural fibers which were carded together, but not combed. The yarn had an average twist of 15.9 tpi and an average twist multiple of 3.8.

B. 18/1 Ne 100% cotton yarns were produced from a blend of 20% natural fibers which were combed according to Process 2 and 80% dyed (uncombed) fibers. The yarn had an average twist of 16.2 tpi and an average twist multiple of 3.9.

C. 18/1 Ne 100% cotton yarns were produced from a blend of 80% dyed fibers and 20% natural fibers which had been combed according to Process 2, with the blended fibers being combed together according to Process 2. The yarn had an average twist of 16.2 tpi and an average twist multiple of 3.9.

The results of the measurements of Samples A, B, and C are listed in the tables labeled as FIGS. 2A, 2B, 3A, and 3B.

As illustrated, the yarns prepared according to the instant invention (i.e., Sample C) had dramatically reduced numbers of thick and thin places, as well as a dramatic reduction in the number of neps. Furthermore, the fiber evenness is dramatically improved, as illustrated by the significant reduction in the coefficient of variation of the yarns of Sample C as compared with those of Samples A and B. In addition, the spread between the highest coefficient of variation and the lowest coefficient of variation for the product made according to the instant invention (Sample C) is also substantially smaller than the spread between the highest and lowest coefficients of variation of the yarns made according to conventional processes (i.e., Samples A and B.) This indicates that yarns made according to the instant invention are consistently more uniform than those which are made according to prior art methods. Furthermore, the tenacity, the elongation, and the force to break were substantially improved.

Example 2

Samples D, E and F of dark grey yarns including 50% dyed fibers and 50% natural fibers were produced as follows. A twist test was conducted for each of the yarns to determine the average turns per inch (tpi) and average twist multiple (tm) as noted below:

D. 18/1 Ne 100% cotton yarns were produced from a blend of 50% scratch combed natural fibers and 50% fibers which were scratch combed, then dyed black. The thus-prepared fibers were then carded together and spun into a yarn. The yarn had an average twist of 16.0 tpi and an average twist multiple of 3.8.

E. 18/1 Ne 100% cotton yarns were produced from 50% natural fibers which were combed according to Process 2 and 50% fibers which were scratch combed, then dyed black. The thus-processed fibers were then spun into a yarn having an average twist of 16.5 tpi and an average twist multiple of 3.9.

F. 18/1 Ne 100% cotton yarns were produced from 50% natural fibers which were combed according to Process 2 and 50% fibers which were dyed black, then combed according to Process 2. The fibers were blended and combed together according to Process 2. The yarn had an average twist of 16.9 tpi and an average twist multiple of 4.0.

The results of the measurements of Samples D, E, and F are listed in the tables in FIGS. 4A, 4B, 5A, and 5B.

As illustrated, the average coefficient of variation for the yarns made according to the instant invention (Sample F) was substantially lower than that for the conventionally produced yarns (Samples D and E), as was the average number of thick and thin places. For example, the Sample F yarns had an average of 22 thick places per 400 yards, as compared with 1291 in the Sample D yarns. Furthermore the Sample F yarns averaged only a single thin place per 400 yard length, as compared with 355 for the Sample D yarns, and the average number of neps for the Sample F yarns was a mere 7 per 400 yard length of yarn. Furthermore, increases in the average break factor, force to break and tenacity were realized.

Example 3

Samples G, H, I, and J of light grey yarns including 9% black dyed fibers and 91% natural fibers were produced as follows:

G. 18/1 Ne 100% cotton yarns were produced from 9% fibers scratch combed as natural, then dyed black and 91% carded natural fibers, with the blended fibers being carded together prior to spinning.

The yarn had an average twist of 16.6 tpi and an average twist multiple of 3.9.

H. 18/1 Ne 100% cotton yarns were produced from a blend of 9% fibers which were dyed black, then combed according to Process 2 and 91% natural uncombed fiber stock. The yarn had an average twist of 16.1 tpi and an average twist multiple of 3.7.

I. 18/1 Ne 100% cotton yarns were produced from 9% fibers which were dyed black, then combed according to Process 2. The dyed combed fibers were blended with 91% natural fibers which had also been combed according to Process 2, and then the blend was combed together according to Process 2. The yarn had an average twist of 16.7 tpi and an average twist multiple of 3.9.

J. 18/1 Ne 100% cotton yarns were produced from 9% fibers which were dyed black, then combed according to Process 2 and 91% carded natural fibers, and the blended fibers were then combed together according to Process 2. The yarn had an average twist of 15.8 tpi and an average twist multiple of 3.8.

The results of the measurements of Samples G, H, I, and J are listed in the tables in FIGS. 6A, 6B, 7A, and 7B.

As indicated in the tables, the yarns made according to the instant invention (i.e., Samples H, I, and J) had lower coefficients of variation (particularly those of Samples I and J, where the blend including the dyed fiber component was combed together.) As indicated, the average number of thick and thin places in Samples I and J was reduced to zero. Furthermore, as indicated by a comparison of Samples G and H, the combing of the dyed fibers after the dyeing process rather than before it produced dramatic reductions in the number of thin and thick places as well as the number of neps.

Thus, yarns made according to the instant invention were found to be more consistently uniform and had reduced thick and thin regions, as well as reduced number of neps. Because the neps are generally readily visible when the yarn is knit or otherwise formed into a fabric, the reduction in neps achieved by the instant invention results in the ability to produce higher quality fabrics with dramatically fewer neps. In addition, the yarns produced according to the instant invention had improved luster, with the blending of the fiber colors being more intimate throughout the yarn. Furthermore, the yarns were stronger than those produced by prior art methods (as illustrated by the increase in force required for break), and the yarns were more consistent in strength, as illustrated by the smaller spread between the highest and lowest forces required for break of the yarn.

Many modifications and other embodiments of the invention will come to mind to one skilled in the art to which this invention pertains having the benefit of the teachings presented in the foregoing descriptions and the associated drawing. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A spun yarn made according to a method comprising:

providing a quantity of first cotton fibers dyed a first color;

combing the dyed first cotton fibers to remove noils and neps therefrom;

providing a quantity of second fibers having a color which is visually distinct from that of said first fibers;

blending together the dyed and combed first fibers and the second fibers to produce a blended stock;

feeding said blended stock to a combing machine and combing said blended stock to remove neps and noils and align the fibers to thereby form combed stock; and thereafter spinning said combed stock into a yarn;

the yarn having less than about 70 neps per 400 yard length.

* * * * *

UNITED STATES PATENT AND TRADEMARK OFFICE

CERTIFICATE OF CORRECTION

PATENT NO. : 6,354,067 B2
DATED : March 12, 2002
INVENTOR(S) : Foil, Jr.

It is certified that error appears in the above-identified patent and that said Letters Patent is hereby corrected as shown below:

Column 3,
Line 38, insert the following:

-- Figures 3A and 3B, when joined at their respective broken ends, show a table of Statimat M Single End Test results corresponding to Example 1;

Figures 4A and 4B, when joined at their respective broken ends, show a table of Uster Evennness Test results corresponding to Example 2;

Figures 5A and 5B, when joined at their respective broken ends, show a table of Statimat M Single End Test results corresponding to Example 2;

Figures 6A and 6B, when joined at their respective broken ends, show a table of Uster Evennness Test results corresponding to Example 3; and Figures 7A and 7B, when joined at their respective broken ends, show a table of Statimat M Single End Test results corresponding to Example 3. --.

Signed and Sealed this

Twenty-seventh Day of August, 2002

*Attest:*

*Attesting Officer*

JAMES E. ROGAN
*Director of the United States Patent and Trademark Office*